US005424965A

United States Patent [19]

Shou et al.

[11] Patent Number: 5,424,965

[45] Date of Patent: Jun. 13, 1995

[54] MULTIPLICATION CIRCUIT FOR MULTIPLYING ANALOG VALUES

[75] Inventors: Guoliang Shou; Weikang Yang; Sunao Takatori; Makoto Yamamoto, all of Tokyo, Japan

[73] Assignee: Yozan Inc., Tokyo, Japan

[21] Appl. No.: 172,393

[22] Filed: Dec. 23, 1993

[30] Foreign Application Priority Data

Dec. 25, 1992 [JP] Japan ..... 4-359432

[51] Int. Cl.[6] ..... G06J 1/00

[52] U.S. Cl. ..... 364/606

[58] Field of Search ..... 364/606, 602, 841; 328/160

[56] References Cited

U.S. PATENT DOCUMENTS 4,042,815 8/1977 Brown et al. ..... 364/841

4,169,287 9/1979 Middendorf et al. ..... 364/835

OTHER PUBLICATIONS

Ochi, Hiroshi, "The Digital—Filter Design Handbook", CQ Suppan Kabushikigaisha, 1991.

*Primary Examiner*—Tan V. Mai

*Attorney, Agent, or Firm*—Cushman, Darby & Cushman

[57] ABSTRACT

A multiplication circuit for multiplying analog values. The multiplication circuit receives a plurality of input voltages and selects one of the input voltages. The multiplication circuit also includes at least one resistor/-capacitor (RC) circuit. The RC circuits includes a resistor for receiving a stepwise start signal and a capacitor, which is connected between a ground potential and the resistor. An output terminal is connected between the resistor and the capacitor. The output terminal outputs an output voltage. The multiplication circuit produces a stop signal when a difference between the selected one of the input voltages and the output voltage is greater than a predetermined value. The multiplication circuit selectively increases or decreases a count value by a number of clock pulses that occur between the stepwise start signal and the stop signal, The multiplication circuit produces a count signal, which is indicative of the count value. The multiplication circuit includes a switch for electrically disconnecting, in accordance with the count signal, the resistor and the capacitor of the RC circuit.

4 Claims, 2 Drawing Sheets

MULTIPLICATION CIRCUIT FOR MULTIPLYING ANALOG VALUES

FIELD OF THE INVENTION

This invention relates to a multiplication circuit.

BACKGROUND OF THE INVENTION

In recent years, there have been complaints about the limitations of a digital computer because of the exponential increase in the amount of money needed for investment in equipment relating to minute processing technology. Thus an analog computer has been receiving a lot of attention. However, in an analog computer, a multi-valued register or memory is needed to store the data and such means have not been realized yet.

SUMMARY OF THE INVENTION

The present invention is invented so as to solve the conventional problems described above and has a purpose to provide a multiplication circuit capable of storing an analog computer's data.

A multiplication circuit according to the present invention converts voltage levels into a time domain by using a charged voltage of an RC circuit and resistors time as a clock number at a digital counter.

PREFERRED EMBODIMENT OF THE INVENTION

Hereinafter an embodiment of a multiplication circuit according to the present invention is described with reference to the attached drawings.

Figure 1:
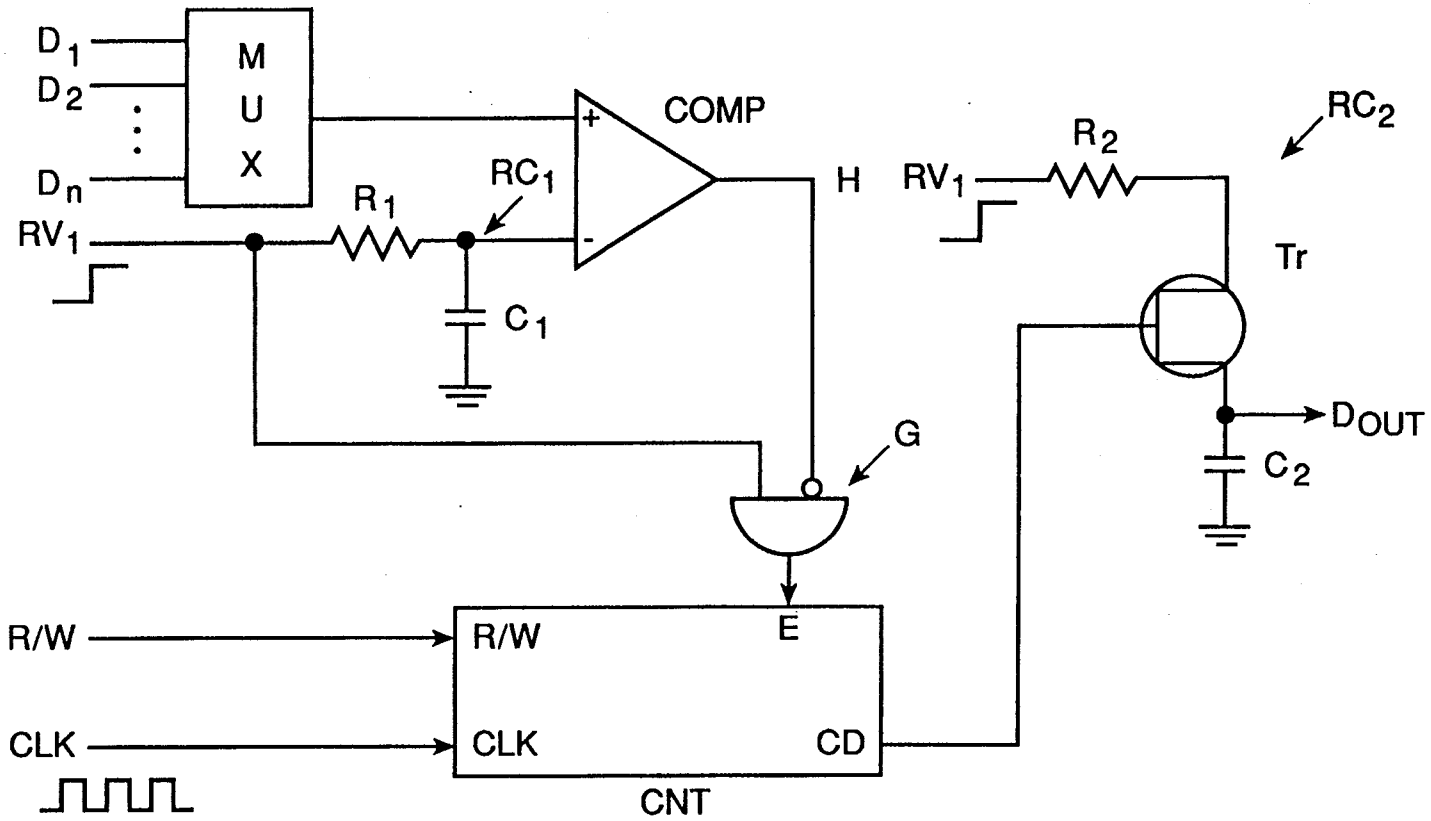
FIG. 1 is a circuit diagram showing a first embodiment of a multiplication circuit according to the present invention.

In FIG. 1, a multiplication circuit has a multiplexer MUX for selectively outputting analog data from $D_1$ to $D_n$ which is to be multiplied. The output of multiplexer MUX is connected to a comparator COMP as a non-inverted input. The first RC circuit $RC_1$ is connected with an inverted input of comparator COMP and a stepwise starting signal $RV_1$ is input to $RC_1$. $RC_1$ is composed of a resistor $R_1$ connected at a first terminal with $RV_1$. Capacitor $C_1$ is connected at a first terminal with a second terminal of $R_1$ and a ground potential at the second terminal. A junction point of $C_1$ and $R_1$ is connected with the inverting input of comparator COMP.

Comparator COMP outputs a "0" when its input $(D_k-RV_1)$ is smaller than 0, and outputs an active "1" when $(D_k-RV_1)$ is greater than 0.

An output of COMP and $RV_1$ are input to a logical gate G having the function of (COMPx$RV_1$). The output of logical gate G is input to a counter CNT as enable signal E. Counter CNT counts during a period from the time when $RV_1$ becomes "1" to the time when the output to COMP becomes "1". Counter CNT has a Read/-Write switching input R/W, a clock input CLK and count data output CD. The following signal definitions are predetermined.

TABLE 1

| |
|---|
| When R/W is equal to 1, then counter CNT counts decrementally. |
| When R/W is equal to 0, then counter CNT counts incrementally. |
| Counter CNT counts the changes from 0 to 1 of clock CLK. |
| When a counter value of counter CNT is positive, then an output is 1. |
| When a counter value of counter CNT is 0, then an output is 0. |

When R/W is equal to 0, a selected one of analog data from $D_1$ to $D_n$, which is defined as $D_k$, is selected by multiplexer MUX. $RV_1$ is defined as "1" and is input to the inverted input of COMP. The electric potential of the inverted input decreases as $C_1$ is charged. When $(D_k-RV_1)$ becomes "0", COMP outputs a holding signal H, which is equal to 1. $RV_1$ is input to gate G simultaneously with the input of $RC_1$. Counter CNT starts the counting of clock CLK and increments the count value. Clock CLK is a pulse train of a predetermined frequency and the final count value of counter CNT corresponds to a difference in time from the time of the inputting of $RV_1$ to time when $(D_k-RV_1)$ becomes "0".

Here, if the voltage of inverted input of comparator COMP is defined as $V_{in}$ and the time corresponding to $D_k$ is defined as $t_k$, then the following formulas are obtained.

$V_{in}=RV_1 \exp(-t_k/R_1C_1$; and $t_k=-R_1C_1\log(D_k/RV_1)$

Finishing the first counting, holding the count values, selecting a new data $D_{k+1}$, and defining $RV_1$ as being equal to 1, then time $t_{+1}$, corresponding to $D_{k+1}$ can be added to $t_k$. Time can be obtained from the following formula, which is stored in counter CNT.

$$t_k+t_{k+1}=-R_1C_1\log\{D_k\times D_{k+1}/(RV_1)^2\}$$

The formula is the time that corresponds to the multiplication result of $D_k\times D_{k+1}$. Storing the time as a count value is equivalent to holding the actual calculation result.

It is possible to perform the same calculation for any number of data, and it is possible to obtain a multiplication result of all data from $D_1$ to $D_k$.

The second RC circuit $RC_2$ has the same characteristics as $RC_1$. $RC_2$ is connected with output CD in order to read a count value of counter CNT. $RC_2$ includes a resistor $R_2$, and a capacitor $C_1$ connected at the first terminal through a transistor Tr and a ground potential at the second terminal. A gate of Tr is connected with output CD. Assuming that R/W is equal to 1, the count value is decreased. When the count value is equal to 0, output CD becomes 0 and Tr is cut-off. $C_2$ is charged during a period from when $RV_1$ is equal to 1 to when CD is equal to 0. The charge voltage at the end of charging becomes an analog data output $D_{out}$ corresponding to the total time. An analog data is calculated as a result of multiplication.

Figure 2:
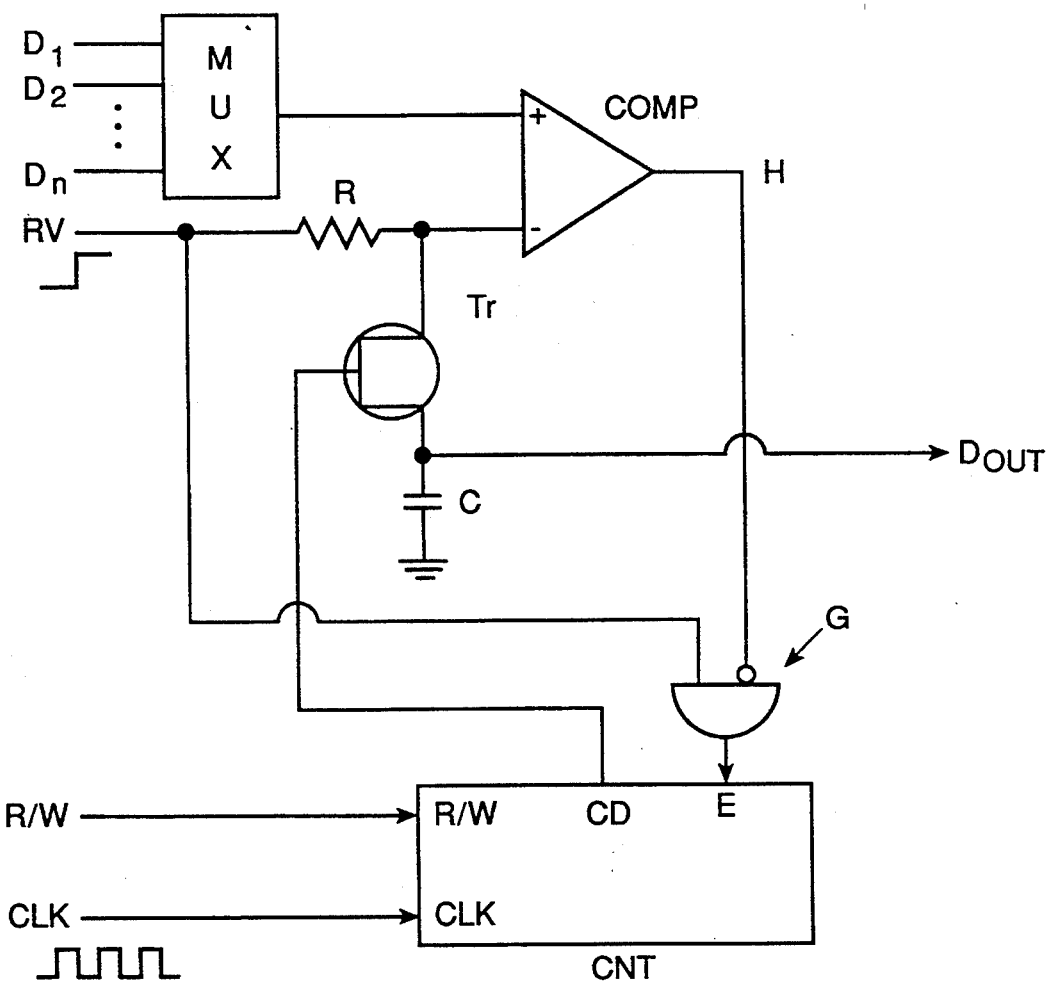
FIG. 2 is a circuit diagram showing a second embodiment of a multiplication circuit according to the present invention.

FIG. 2 shows a second embodiment in which the first and the second RC circuits are the same circuits.

When R/W is equal to 0, CD is equal to 1 and Tr is conductive. When RV is equal to 1, C is charged through R and Tr. When a count is stopped (i.e., when H is equal to 1), a time corresponding to data $D_k$ is added to the count value. When R/W is equal to 1, the count value is decreased. When the value becomes equal to 0, CD is equal to 0. Then Tr is cut-off and the charged voltage of C becomes an analog data output $D_{out}$.

In the second embodiment, the RC circuit is mutual so that it is possible to prevent a decline in accuracy of calculation which could be caused by different characteristics of RC circuits.

As mentioned above, a multiplication circuit according to the present invention converts voltage levels into the time domain by using the charge voltage of an RC circuit and registers time as a number of clock pulses at a digital counter, so that it is possible to provide a multiplication circuit capable of storing data.

What is claimed is:

1. A multiplication circuit comprising:

selector means for receiving a plurality of input voltages and for outputting a selected one of the input voltages;

a first and a second RC circuit, each RC circuit including:

a resistor for receiving a stepwise start signal;

a capacitor connected between a ground potential and the resistor; and an output terminal, connected between the resistor and the capacitor, for outputting an output voltage;

comparator means, connected to the receiving means and the output terminal of the first RC circuit, for producing a stop signal when a difference between the selected one of the input voltages and the output voltage of the first RC circuit is greater than a predetermined value;

counter means, connected to the comparator means, for receiving the stepwise start signal, the stop signal, and a reference clock signal having clock pulses of a predetermined frequency, for selectively increasing or decreasing a count value by a number of clock pulses between the stepwise start signal and the stop signal, and for outputting a count signal, which is indicative of the count value; and switching means, connected between the counter means and the second RC circuit, for electrically disconnecting, in accordance with the count signal, the resistor and the capacitor of the second RC circuit.

2. A multiplication circuit according to claim 1, wherein the counter means includes means for receiving a read/write signal and the counter means selectively increases or decreases the count value based upon the read/write signal.

3. A multiplication circuit comprising:

means for receiving a plurality of input voltages and for outputting a selected one of the input voltages;

an RC circuit having:

a resistor for receiving a stepwise start signal and for outputting a voltage;

a capacitor connected between a ground potential and the resistor; and an output terminal, connected to the capacitor, for outputting an output voltage;

comparator means, connected to the receiving means and the resistor, for producing a stop signal when a difference between the selected one of the input voltages and the voltage outputted by the resistor is greater than a predetermined value;

counter means, connected to the comparator means, for receiving the stepwise start signal, the stop signal, and a reference clock signal having clock pulses of a predetermined frequency, for selectively increasing or decreasing a count value by a number of clock pulses between the stepwise start signal and the stop signal, and for outputting a count signal, which is indicative of the count value; and switching means, connected between the counter means and the RC circuit, for electrically disconnecting, in accordance with the count signal, the resistor and the capacitor of the RC circuit.

4. A multiplication circuit according to claim 3, wherein the counter means includes means for receiving a read/write signal and the counter means selectively increases or decreases the count value based upon the read/write signal.

* * * * *